United States Patent [19]

Bangerter et al.

[11] Patent Number: 4,577,861

[45] Date of Patent: Mar. 25, 1986

[54] EXERCISE MACHINE FOR LIMB EXTREMITY DIGITS

[75] Inventors: Blauer L. Bangerter; James M. Streeter, both of Provo, Utah

[73] Assignee: Brigham Young University, Provo, Utah

[21] Appl. No.: 617,081

[22] Filed: Jun. 4, 1984

[51] Int. Cl.[4] ..... A63B 23/04

[52] U.S. Cl. ..... 272/96; 272/67; 272/117; 272/118; 272/134

[58] Field of Search ..... 272/117, 67, 96, 116, 272/118, 134, 136, 138, 130; 128/25 B, 26, 25 R

[56] References Cited

U.S. PATENT DOCUMENTS

| | | | |
|---|---|---|---|
| 2,206,902 | 7/1940 | Kost | 272/96 X |
| 2,250,493 | 7/1941 | Milne | 272/96 |
| 2,255,066 | 9/1941 | Lamb | 128/25 B |
| 2,542,074 | 2/1951 | Bierman | 272/67 X |
| 2,720,396 | 10/1955 | Pfaos | 272/96 X |
| 3,347,547 | 10/1967 | Hynes | 272/67 |
| 3,782,719 | 1/1974 | Kuhlman | 272/67 |
| 3,789,836 | 2/1974 | Girten | 128/25 B |
| 3,824,994 | 7/1974 | Soperberg, Sr. | 128/25 R |
| 4,039,183 | 8/1977 | Sakurada | 272/67 |
| 4,310,154 | 1/1982 | Kauffman | 272/67 |
| 4,444,389 | 4/1984 | Wrocke | 272/96 |

*Primary Examiner*—Richard J. Apley

*Assistant Examiner*—Robert W. Bahr

*Attorney, Agent, or Firm*—M. Ralph Shaffer

[57] ABSTRACT

An exercise machine or device for progressively and increasingly strengthening the muscles of normal subjects associated with the limb extremity digits or phlanges, i.e., the fingers and toes. The basic component comprises a limb extremity platform and, coupled thereto by suitable pivot or hinge, a forward, movable digits' support member essentially disposed in the same plane as said platform, when disposed in a normal or medial-point operative position. Structure for resisting digits' pressure upon the digit support member is connected thereto at an outer margin thereof, such structure generally comprising a flexible elongate connector such as a cable which is routed over a support pulley. The remaining extremity of the connector will generally be associated with weight means, generally permitting differential loading in small pound increments, e.g., one to five pounds. The machine or device is usable for strengthening the muscles of either the fingers or toes of the user. In one form of the invention, the juncture between the limb extremity platform and the foot digits' support member is arcuate and corresponds generally to a locus passing through the metataursal phalangeal joints, at least the central forward portion of the platform being convex and being received by a corresponding concave portion as to the digits' support member.

12 Claims, 12 Drawing Figures

EXERCISE MACHINE FOR LIMB EXTREMITY DIGITS

FIELD OF INVENTION

The present invention relates to exercising machines and devices, and more particularly, to a new and improved machine or device for strengthening the muscles associated with the digits, i.e., fingers or toes, associated with the user's limb extremities, i.,e., hands or feet. The machine or device can be used independently or as part of other gymnastic exercise equipment.

BACKGROUND OF INVENTION

In common use are a number of different types of exercise equipment for strengthening various muscles of the body. These relate to leg and back muscles, arm and shoulder muscles, and so on. Neglected in the field has been the provision for exercising the toes and fingers of the athlete. Strengthening of toe and finger muscles is highly desirable, moreover, in certain types of athletic activities and sports. Ballet dancers, basketball players and athletes engaged in other activities such as broad-jump, tennis, and so forth, improve their performance where provision is made for toe flexor exercises. Additionally, in sports requiring increased finger strength and finger dexterity, a need is present for suitable machines to so strengthen the finger muscles. Certain improvements have been made in exercise machines in general, whereby pulley support for flexible elongate members are cam-shaped rather than circular, thereby including in the design of the machine a varying lever arm and hence varying resistance for the flexible elongate member to the movable exerciser portion to which the cable is attached. This technique may likewise be incorporated in the present invention. However, no art is known, nor are the inventors aware of any machine or device which concentrates upon increasing the strength of the muscles of the toes and fingers, especially the intrinsic muscles of foot or hand which cause phalangeal flexion.

BRIEF DESCRIPTION OF PRESENT INVENTION

Before describing the invention, terms that will be used herein are now defined. The "metacarpal" phalangeal joints refers to the large knuckles of the hand which are rearward of the middle and front knuckles. "Metataursal" phalangeal will refer to the metataursal phalangeal joints of the feet, namely, the large joints of the foot which are the most rearward of the toe extremities. "Phlanges" and "digits" are common generic terms relating to the fingers or toes of the athlete, as the case may be. "Limb" as used herein refers to the leg or arm. The "extremity" refers to the hand or foot. "Digits" extend from the particular limb extremity in question.

In the invention, a limb extremity platform is provided which supports such extremity, i.e., hand or foot. Preferably, a strap will be used to maintain the heel of the hand or foot against the platform provided. Pivot means such as hinge means are provided, which pivot means pivotally mount a digits' support member in proximity with the limb extremity platform. The pivot axis will generally and preferably be above the upper surface of the platform and roughly aligned with the outer, opposite phalangeal metataursal or metacarpal phalangeal joints of the limb extremity in question. Where a toe exerciser is contemplated, the pivot means should have an angle between 73 and 77 degrees relative to the major or longitudinal axis of the limb extremity platform. After a series of tests and foot measurements for variety of feet of different sizes, it has been found that this angle limitation is highly preferred so as to accommodate the general angulation as to the orientation of the metataursal phalangeal joints; especially for feet, it is highly desired that the juncture of the limb extremity platform and the digit support member be curved, i.e. in accordance with the general orientation of an imaginary locus passing through the foot's metataursal phalangeal joints, and thus the forward portion of the limb extremity platform being convex to fit into the corresponding concave portion of the rearward margin associated with the digits' support member. The general orientation of this curved juncture as to toe exercisers, will thus correspond essentially with the shape of the ball of the foot relative to the metataursal phalanged joints. The device can be used separately, constitute a machine dedicated to digits' flexor exercisers, or the same can be incorporated in other gymnastic equipment. For example, the machine form employed can be designed to exercise toes and fingers simultaneously; or, the user might exercise simultaneously his leg muscles and toe muscles in a suitable leg-press-type machine.

OBJECTS

Accordingly, a principle object of the present invention is to provide a machine or device suitable for exercising the toes and/or fingers of the user.

A further object is to provide a device having a digits' support member coupled by suitable pivot means to or proximate a limb extremity platform, with resistance means incorporated in the design at the digits' support member for permitting toe flexure, by way of example, to strengthen the toes muscles of the user.

A further object is to provide a device for incorporation in existing gymnastic equipment whereby the user might sequentially or even simultaneously exercise his fingers or toes in connection with accomplishing other exercise functions as to other muscles or parts of the body.

An additional object is to provide a toe exerciser device accommodating the orientation of the metataursal phalangeal toe joints.

An additional object is to provide a machine for exercising the muscles of the toes and/or fingers of the machine's user.

An additional object is to provide universal-type gym apparatus wherein the same incorporates a finger and/or toe flexor muscle strengthening device.

BRIEF DESCRIPTION OF DRAWINGS

The features of the present invention, together with other objects and advantages thereof, may best be understood by reference to the following description, taken in connection with the accompanying drawings, in which.

DETAILED DESCRIPTION OF PREFERRED EMBODIMENTS

Figure 1:
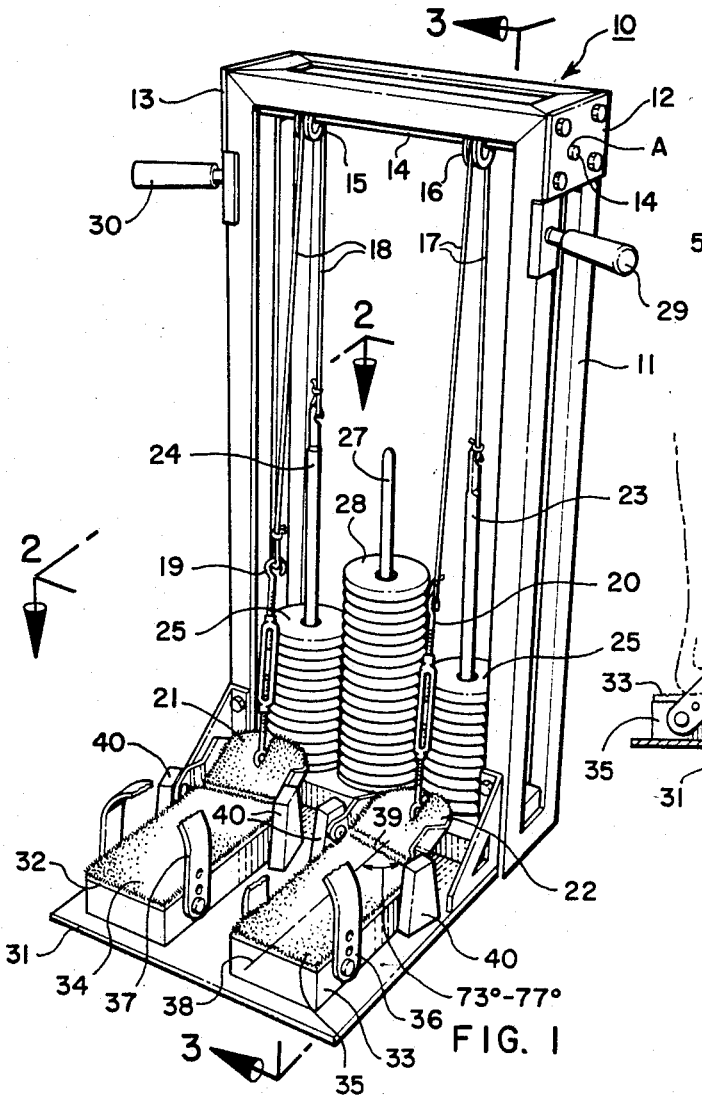
FIG. 1 is a perspective view, partially broken away in the strap area, of a toe exerciser machine made in accordance with the principles of the present invention.
Figure 5:
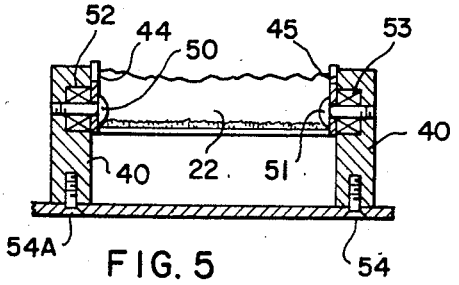
FIG. 5 is a longitudinal horizontal section taken along the line 5—5 in FIG. 2.

In FIGS. 1–5 the toe exerciser machine 10 includes an upstanding framework 11 provided with opposite plates 12 and 13 which support shaft 14 at respective apertures A, one being shown. The shaft 14 has a pair of pulleys 15 and 16 journalled thereto, said pulleys accommodating and supporting flexible elongate connectors 17 and 18 which loop over the respective pulleys. One end of each of the connectors is coupled to a respective turnbuckle 19 and 20, the latter being attached at proximate midpoints, i.e., between the second and third toe positions, of digits' support members 21 and 22. The remaining ends of connectors 17 and 18 are connected to vertically movable posts 23 and 24 which support a series of weights 25. The number of weights selected will depend upon the resistance desired as to toe flexor movement. Post 27 is stationary and can accommodate in storage a number of weights 28.

The framework 11 is provided with handle grips 29 and 30 which are angulated as shown for the comfort and convenience of the user. Extending outwardly and attached to framework 11 is a base 31, the same including limb extremity platforms 32 and 33. These may comprise blocks of wood or other suitable means that preferably have a pile-type of carpeting or other similar material as a covering for coverings 34 and 35. The platforms 32 and 33 each have straps 36 and 37 that can be made self-attaching by including the usual Velcro® material, or materials similar thereto. Any number of types of foot straps can be employed so that the heel of the limb, namely the foot heel, can be secured downwardly directly against the upper surface of the respective platform.

The longitudinal axis 38 and the junction line 39 as between the platform and the digits' support means enjoy an angular relationship of from 73° to 77°. This angle is important and has been determined during a series of tests involving many different types of feet. This angle is the approximation of the metataursal phalangeal juncture of the foot where the metataursal joints are present, relative to the foot's longitudinal axis.

Figure 2:
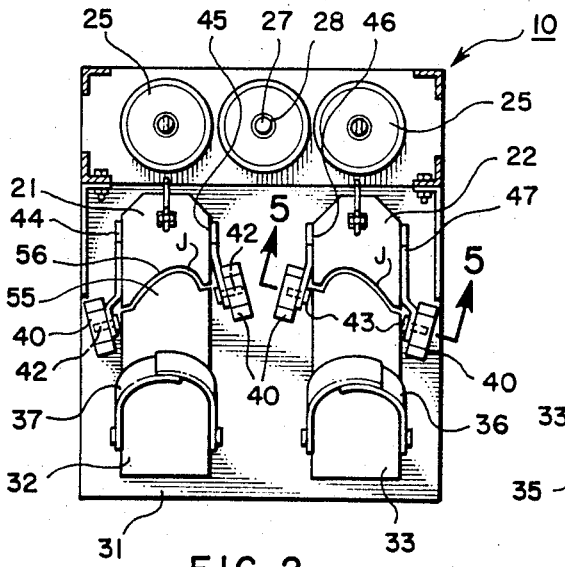
FIG. 2 is a top plan taken along the line 2—2 in FIG. 1.
Figure 12:
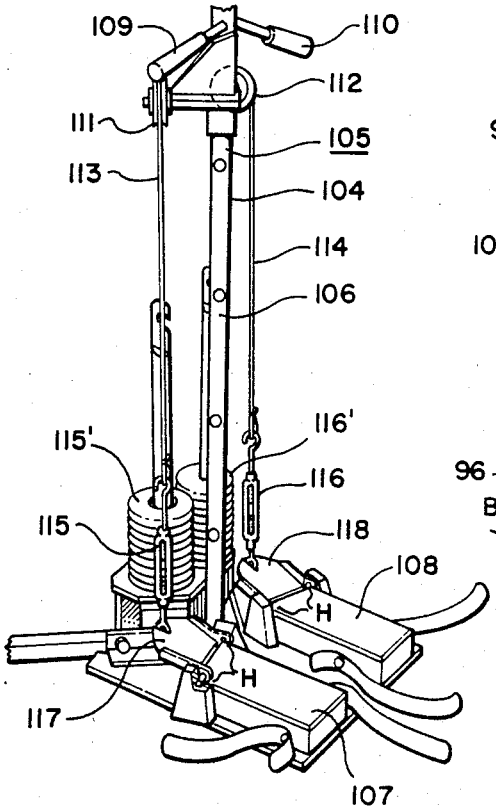
FIG. 12 is a fragmentary perspective view of the corner of a universal gym type equipment, wherein the corner frame area thereof is supplied with toe exerciser equipment as in adjunct thereto.

As to relative physical attachment of the digits' support members 21 and 22 relative to their respective platforms 32 and 33, the same may be pivot connections as seen in corresponding structure in FIG. 12, relative to pivot areas H; upstanding bosses 40, four being shown, may be integral with or attached to the base 31 associated with platforms 32 and 33, with respective boss pairs being provided with stub shafts 42 and 43 to which the angled members, fixed to the digits' support members, are journalled. These angled members are best seen in FIG. 2 and are designated 44–47. In such event, the angled members will have suitable apertures and bearings, not shown, for receiving the stub shafts 42 and 42, respectively. The pivot axis will be disposed above the upper surfaces of the platform and roughly in line with the metataursal phalangeal joints.

Alternately, arms 44–47 may have outwardly extending pivot pins 50 and 51 which are journalled in bearings 52 and 53 associated with risers or bosses 40.

The bosses themselves may be either secured to the limb extremity platforms directly or to the supporting base thereof at 31 and attached thereto by attachments 54, 54A.

Figure 4:
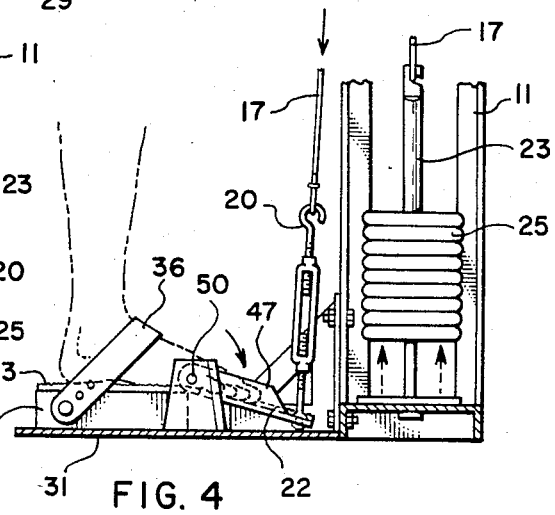
FIG. 4 is similar to FIG. 3 as to the lower portion thereof, indicating the toes or digits as being in a declining position rather than in an inclined position.
Figure 3:
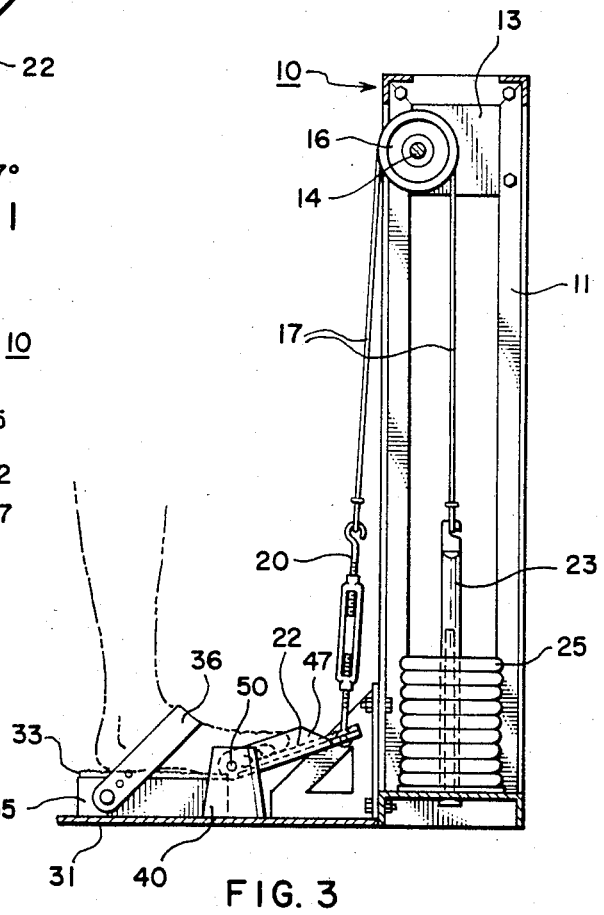
FIG. 3 is a section taken along the line 3—3 in FIG. 1.

Whether the pivot or hinge construction be direct or indirect relative to the pivotal nature of digits' support members 21 and 22 as to platforms 32 and 33, still it will be understood that the platforms support feet from the metataursal area rearwardly, whereas the toes are exercised by the user positioning his toes on the two digits' support members, and then pressing down with his toes from the position seen in FIG. 3 to that shown in FIG. 4.

In practice, it is contemplated that digits' support members is initially raised to a position 20° to 40° relative to the horizontal. See FIG. 3. During depression intervals wherein the toes do press downwardly upon the digits' pedal or platform, it is submitted that the angle of depression may extend to about 20°, see FIG. 4. The footstrap as seen at 36 in FIG. 4, indicates that the user's foot, and especially the heel portion thereof, is maintained firmly downwardly on the platform during the exercise or flexure functions of the toes.

FIG. 2 illustrates an important concept: namely, that the digits' support member and platform may meet at an arcuate juncture as shown at J in FIG. 2. This is to say, the medial forward portion 55 of the platform will be arcuate and convex forwardly so as to fit into the concave portion at 56 of the rearward margin of the digits' support member. Accordingly, the curved area can be designed to correspond roughly to a locus passing through the metataursal phalangeal joints of the foot. In this way, maximum support is achieved throughout the ball of the foot, whereas the toe support member is configured such that all of the toes will rest conveniently and effectively on support member during the exercise function. Turnbuckles 19 and 20 will be tightened so that the proper initial angulation is achieved for the digits' support members 21 and 22; preferably this should be of the order of from 20° to 40° relative to the horizontal.

In operation, the weight means is loaded with one or more of a series of 2½ pound weights; the weight is chosen so that the user can lift the weights from 3 to 5 times during a set but will be unable to lift completely in the area of 6 or more times. Three to five repetitions maximum for five sets should be done with one minute rest periods between sets. Each repetition should move the toes down quickly to a position below the horizontal or at least to the horizontal, then held for five seconds, and then slowly return to its starting position. The user should perform the exercise at least three times per week for maximum toe-strength gains.

Figure 6:
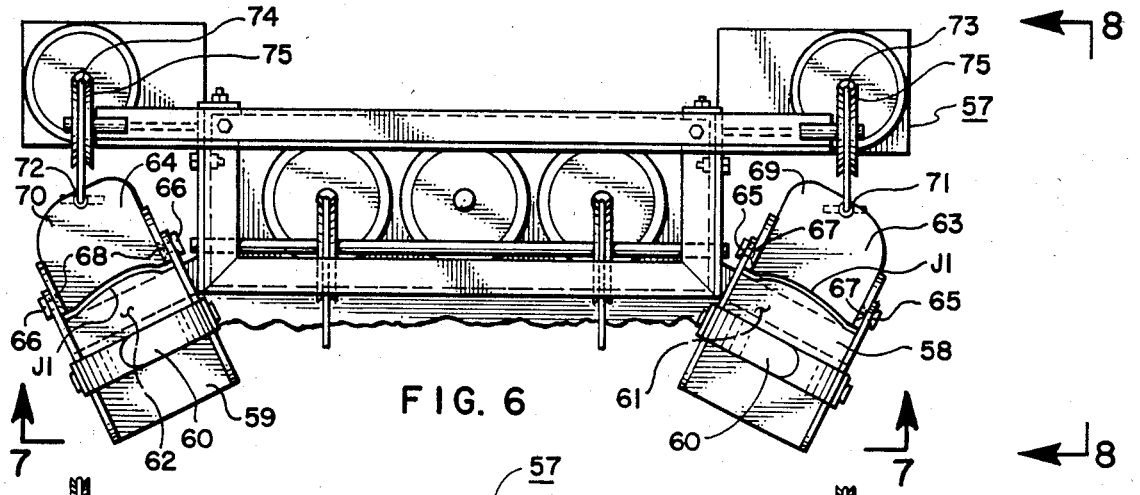
FIG. 6 is a plan view of the structure of FIG. 1, but wherein the handle grips have been replaced by finger exerciser means.
Figure 7:
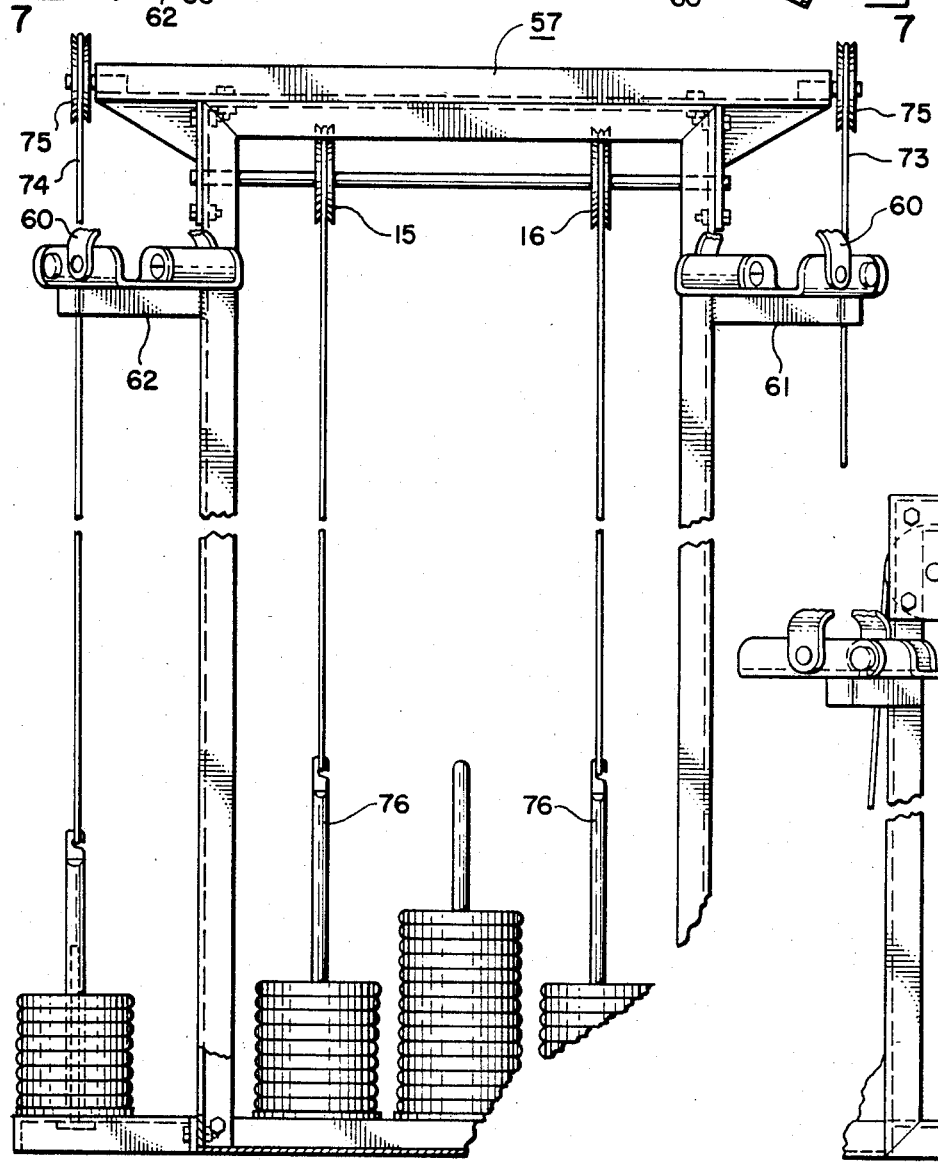
FIG. 7 is a front elevation of the structure of FIG. 6 with the toe exerciser means being not shown, for purposes of clarity.
Figure 8:
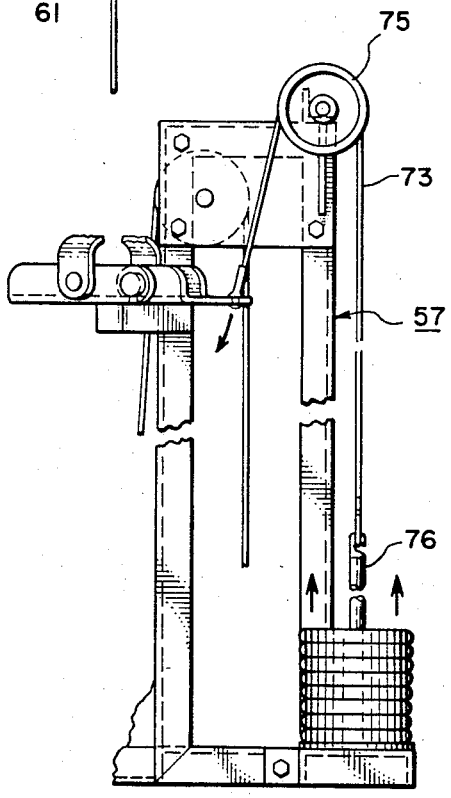
FIG. 8 is a side elevation of the structure of FIGS. 6 and 7, illustrating the manner in which the fingers of the user of the machine may be exercised.

The machine 57 of FIGS. 6–8 is essentially identical to that shown in FIGS. 1–5 with the exception that, included in the toe exerciser machine is finger exerciser equipment which is used in lieu of the handle grips 29 and 30 in FIG. 1. Thus, hand platforms 58 and 59 are each provided with straps 60 for holding the heel of the hand down during the exercise function. These hand platforms are attached to suitable bracket means 61 and 62 which form part of the machine 57. Digits' support members 63 and 64 are hinged or otherwise pivoted to the hand platforms by means of pivot pins 65 and 66 that serve as pivot pins or hinge pins joining the platforms to the digits' or fingers' support members 63 and 64. A suitable bearing mount can be included at 67 and 68 for each of the fingers' support means so that a realistic pivot or hinge can be provided. Curvature J1 corresponds to metacarpal phalangeal joints' orientation.

Figure 10:
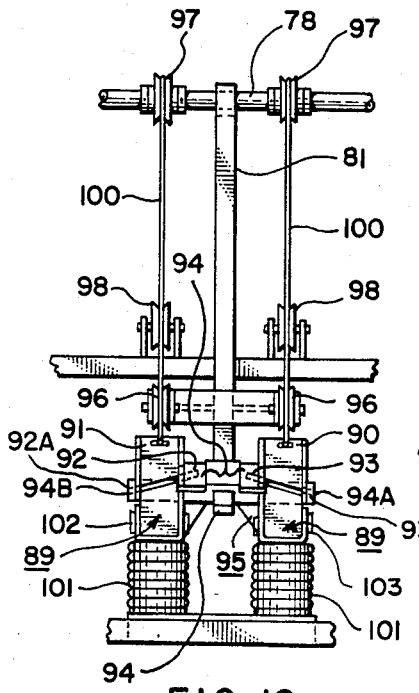
FIG. 10 is a front elevation of the machine in FIG. 9 and is taken along the line 10—10 in FIG. 9.
Figure 9:
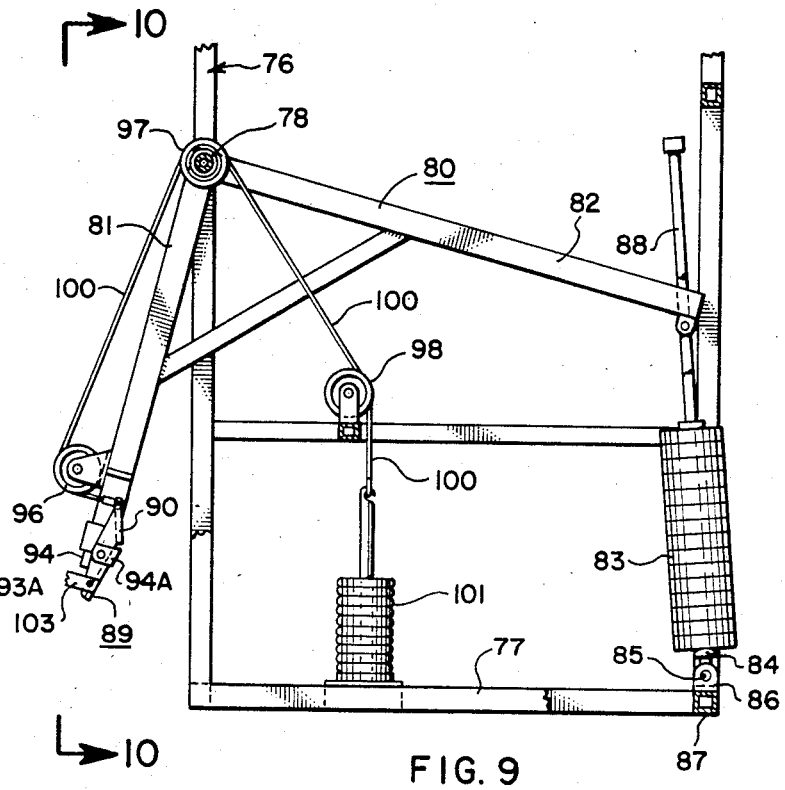
FIG. 9 is a side elevation of a leg press exerciser, but wherein the cross-member of the foot support is provided with toe exerciser means.
Figure 11:
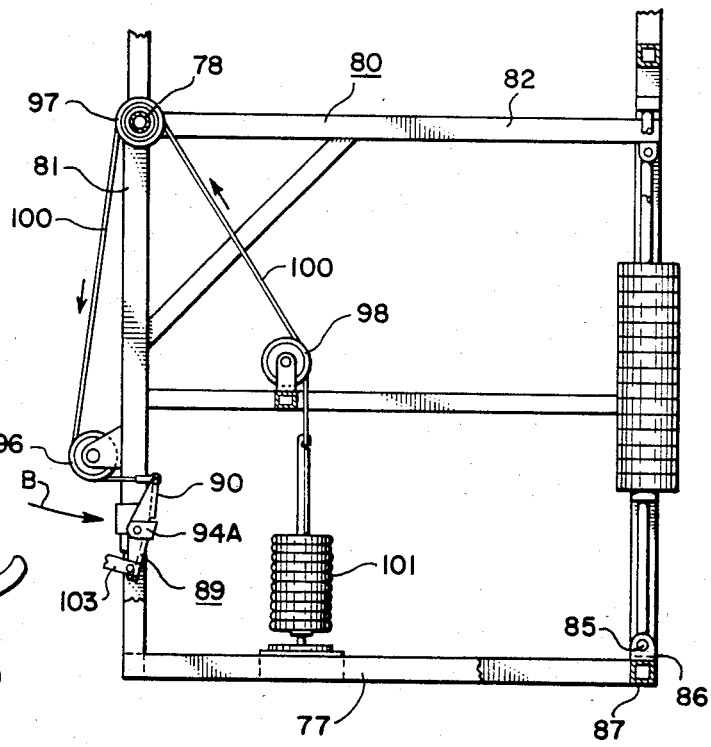
FIG. 11 indicates a depression by the feet of the leg exerciser member of the structure of FIGS. 9 and 10, indicating the counter-clockwise pivotal movement of the structure. It is noted that this can be accomplished with a simultaneous actuation, if desired, of the toe flexor or exerciser portion of the machine.

The forward margins 69 and 70 of the fingers' support members are attached to the ends 71 and 72 of cables 73 and 74. These cables proceed over pulleys 75, one being shown in FIG. 8, and the cables lead down for connection to weight means 76. The weight means is conventional, and weights may be removed or added to the weight system in accordance with standard practice. Thus, the structure of FIGS. 6, 7, and 8 illustrates that finger exercise equipment can be added to a toe flexor machine so that both the fingers and the toes may be exercised simultaneously by a single machine. In operation as to the augmented structure of FIGS. 6–8, the user places his hands over the respective platforms 58 and 59, the hands are strapped in place, if desired, and then the user will simply depress the support members for the fingers at 63 and 64 so as to exercise the fingers in a pattern similar to the toe exercise procedure hereinbefore described. Alternate structure is shown in FIGS. 9–11 as relates to a leg exercise machine. The basic machine, excepting for the toe flexor addition, is standard in the art and is generally part of a universal gym assembly. Thus, framework 76 will include a supporting base 77 and a crossbar 78 which journals member 80. Member 80 has a pair of legs 81 and 82, the latter of which is standard and connects to weight means 83 in a conventional manner. The weights are lifted on a support rod 84 which is pivoted at 85 to upstanding bosses 86 supplied support framework 87. Accordingly, pressure in the direction shown by Arrow B in FIG. 11 will lift the weights 83 so that the leg muscles are flexed and properly exercised. The present invention includes the important addition of a cross-member 89 (FIG. 10) to arm 81. The cross-member 89 is thus shown to include toe support members 90 and 91 which are in pivoted or hinged relationship relative to the platforms 89. This can be accomplished by pivot means 92, 92A and 93, 93A extending into the blocks 94, 94A, 94B of the cross-member 95. Pulleys 96, 97, and 98 are journalled to cross-bar or shaft 78 and the remaining gym structure as indicated, and accommodate cables 100 or other flexible elongate connectors which proceeds around the pulleys and down to weight means 101. Accordingly, the weight means 83 is for the leg muscles, whereas weights 101 are provided for the toe flexor muscles. It is to be noted that at any point of press for the leg machine, the toe support members are immediately available for exercise. Straps may be supplied the cross-member as at 102 and 103 in a manner similar to that shown for the other equipment.

A framework 104 of universal type gym equipment 105 is provided with corner area 106, to which corner area platforms 107 and 108 are affixed or are at least proximately disposed relative thereto. Handle grips 109 and 110 may be supplied with framework if desired. Pulleys 111 and 112 are journalled to the framework, and looped therearound are flexible elongate connectors or cables 113 and 114. These cables lead to turnbuckles 115 and 116 as indicated, which are attached to the toe support members 117 and 118 in a pivotal manner and similar as to that shown in the structure of FIG. 1. Foot straps are provided as indicated. The structure will essentially be that shown in FIG. 1, saving for the adaptation and modification thereof to fit adjacent and exterior corner of a universal gym. Weight means 115' and 116' are provided, are selectable in number, and are constructed for coupling to the cables as indicated. Accordingly, the structure at FIG. 12 will be a welcome addition to a universal gym wherein, not only are the arms and legs accommodated for muscle flexure, but likewise the toes of the user can be exercised.

While the structure offering resistance to the cables to thereby increase the flexor strength of the toes and fingers has been described in terms of weights, it would be understood that other types of resistance devices may be used such as electromagnetic devices, friction devices, and so forth. In the practical sense, the customary weights will generally be the most suitable for incorporation in the invention. In operation as to the structure of FIGS. 9–11, the user places his feet on the platforms 89, generally will strap the feet in place although this may not necessarily be the case, and in any event will place his toes on the movable hinged portions or support members at 90 and 91. The toes of course can be used in an exercise mode in addition to or in lieu of leg press exercises.

The structure of FIG. 12 is essentially the same as that seen in FIG. 1.

Accordingly, what is provided is digits' exercise equipment for both hands and feet, to be used alternatively, simultaneously, or in conjunction with other exercise equipment.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

We claim:

1. A digits' exerciser device including, in combination: a fixed, limb extremity planar platform having an upper surface; a movable digits' support member having an upper planar surface essentially disposed, when at a medial-point operative position, in the same plane of said platform upper surface; transversely disposed pivot means pivotally mounting said support member proximate said platform at a common juncture for lateral pivotal movement of said digits' support member, relative to said platform, in accordance with digits' pressure thereon; strap means coupled to said support member and positioned and dimensioned for constraining said limb extremity to and against said platform at a position such that the metacarpal/metataursal phlangeal joints of such digits are proximate the said juncture of said platform and said digits' support member; and means for selectively, progressively resisting said digits' pressure coupled to said digits' support member.

2. A digits' exerciser device including, in combination: a fixed, limb extremity platform having an upper surface; a movable digits' support member having an upper surface essentially disposed, when at a medial-point operative position, in the same plane of said platform upper surface; transversely disposed pivot means pivotally mounting said support member proximate said platform for lateral pivotal movement of said digits' support member, relative to said platform in accordance with digits' pressure thereon; and means for resisting said digits' pressure coupled to said digits' support member, and wherein said resisting means comprises a flexible elongate connector laterally coupled at one end to said digits' support member, a fixed pulley supporting said flexible elongate connector intermediate its ends, and weight means coupled to said flexible elongate connector at its remaining end for resisting said digits' support member toward the latter's original position.

3. The structure of claim 2 wherein said digits' support member is initially inclined by an acute angle of approximately 40° or less relative to said platform, said platform and support member being provided with upper carpeting layers.

4. The structure of claim 2 wherein said platform is provided with adjustable strap means constructed for encompassing an upper portion of the limb extremity for retaining the heel of said limb extremity against said platform.

5. The structure of claim 2 wherein said platform has a single, uniform longitudinal axis, and, when said device is designed as a toe flexor device, said pivot means has a horizontal pivot axis displaced at an angle between 73° and 77°, canted horizontally and laterally outwardly relative to said longitudinal axis of said platform.

6. The structure of claim 2 wherein said device is constructed for pivotal movement of said digits' support member normal to the plane thereof and relative to said limb extremity support, of between +40° and −20°.

7. The structure of claim 2 wherein, when digits' exercise device is intended for use as a foot digits' exerciser, said digits' support member has a rear concave portion, said platform has a corresponding forward convex portion, shaped to correspond generally with a locus passing through the metataursal phalangeal joints of the user, received onto said concave portion of said digits' support member.

8. The structure of claim 2 wherein said platform has a single, uniform, essentially horizontal longitudinal axis, the pivot axis of said pivot means being canted and raised above said platform upper surface, whereby to approximate the axis of digits' flexor movement.

9. A foot-digits exerciser machine including, in combination: platform means having an ankle strap; digits' support means nominally disposed essentially in the same plane as said platform means and also constructed for up-and-down movement normal to the plane of said platform means; a riser provided with hand-support means and a vertical cable-support pulley; cable means having one end fixed to said digits' support means and a remaining end looped over said pulley; and weight means coupled to said remaining end of said cable means.

10. The structure of claim 9 wherein said platform means comprises a pair of side-by-side disposed platforms, said digits' support means comprising a pair of digits' supports respectively hinged relative to said platforms and nominally disposed essentially in the same planes thereof, each of said platforms being floor-supported and having upper surfaces raised so as to accommodate angular declines of said digits' supports relative thereto, said cable means including a cable yoke having mutually-spaced ends respectively coupled to opposite forward margins of said digits' supports.

11. The structure of claim 10 wherein said hand support means comprises a pair of mutually-spaced hand platforms, a pair of hand digits' supports respectively, essentially, and nominally disposed in the same planes of said hand platforms and also respectively transversely pivoted relative to said hand platforms, horizontally journalled fixed pulley means, weight means, and cable means engaging and supported by said pulley means and having opposite ends respectively coupled to said weight means and said hand digits' supports proximate forward outer margins of the latter.

12. In a weight-lift machine having an upstanding framework: an improvement comprising side-by-side disposed foot platforms displaced proximate to but exterior of said framework, each of said platforms being provided with digits' supports essentially and nominally coplanar with said platforms, respectively, and pivoted relative thereto at horizontal axes and at respective angles of from 73°–77°, canted rearwardly-outwardly, relative to the longitudinal orientation of said platforms; vertical pulley means supported by and journalled to said framework; weight means; cable means having opposite ends, one of said ends being provided with a yoke extension, said yoke extension being coupled to each of said digits' supports proximate outer margins thereof, the remaining end of said cable means being coupled to said weight means.

* * * * *